US008123338B2

(12) United States Patent
Ogata

(10) Patent No.: US 8,123,338 B2
(45) Date of Patent: Feb. 28, 2012

(54) LIQUID DROPLET JET HEAD, LIQUID DROPLET DISCHARGING APPARATUS, AND IMAGE FORMING APPARATUS

(75) Inventor: Kenichi Ogata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 344 days.

(21) Appl. No.: 12/556,936

(22) Filed: Sep. 10, 2009

(65) Prior Publication Data

US 2010/0066789 A1 Mar. 18, 2010

(30) Foreign Application Priority Data

Sep. 16, 2008 (JP) ..... 2008-237128

(51) Int. Cl.
*B41J 2/045* (2006.01)

(52) U.S. Cl. ..... 347/70

(58) Field of Classification Search ..... None
See application file for complete search history.

(56) References Cited

U.S. PATENT DOCUMENTS

| | | | |
|---|---|---|---|
| 6,729,716 | B2 | 5/2004 | Eguchi et al. |
| 7,264,338 | B2 | 9/2007 | Ogata et al. |
| 2009/0189958 | A1 | 7/2009 | Ogata |

FOREIGN PATENT DOCUMENTS

| | | |
|---|---|---|
| JP | 3248486 | 11/2001 |
| JP | 3381678 | 12/2002 |
| JP | 2004-160941 | 6/2004 |

*Primary Examiner* — Matthew Luu
*Assistant Examiner* — Lisa Solomon
(74) *Attorney, Agent, or Firm* — Cooper & Dunham LLP

(57) ABSTRACT

A liquid droplet jet head includes a pressure liquid chamber substrate including nozzles discharging liquid droplets and pressure liquid chambers communicated with the nozzles, a vibration board partially forming wall surfaces of the pressure liquid chambers, and a pressure converter vibrating the vibration board to change pressure in the pressure liquid chambers to discharge the liquid droplets from the nozzles, and including a piezoelectric element having an active region and a inactive region and electrodes disposed to apply an electric force to the active region and not to apply an electric force to the inactive region, and a groove separating the active region from the inactive region formed not so deep as to reach one of the electrodes in a portion in the inactive region facing the vibration board. In the liquid droplet jet head, the pressure liquid chamber substrate is supported by the inactive region of the piezoelectric element.

7 Claims, 14 Drawing Sheets

LIQUID DROPLET JET HEAD, LIQUID DROPLET DISCHARGING APPARATUS, AND IMAGE FORMING APPARATUS

BACKGROUND OF THE INVENTION

1. Field of the Invention

The present invention generally relates to a liquid-droplet jet head having plural nozzles discharging liquid droplets, a liquid discharging apparatus including the liquid-droplet jet head, and an image forming apparatus including the liquid discharging apparatus.

2. Description of the Related Art

Image forming apparatuses operate by discharging liquid droplets onto recording sheets such as paper to form images on the recording sheets. Such an image forming apparatus generally includes a liquid-droplet jet head having plural nozzles communicated with pressure liquid chambers, and pressure converters (actuators) provided to the corresponding pressure liquid chambers.

FIG. 1 is a view illustrating one example of a liquid-droplet jet head according to a related art.

A liquid-droplet jet head 10 includes a vibration board 3 partially forming a wall surface (hereinafter also called as "first surface of the vibration board") of a pressurized chamber 2 communicated with a nozzle 1, and an actuator 5 provided on a supporting substrate 4. In the liquid-droplet jet head 10, the vibration board 3 and the actuator 5 are connected via a connecting unit 6. The vibration board 3 is elastically deformed with displacement of the actuator 5. A second surface of the vibration board 3 (i.e., the other side of the wall surface of the pressurized chamber 2) is less rigid than other surfaces forming the pressure liquid chamber 2 to efficiently change the capacity of the pressure liquid chamber 2 by displacing the actuator 5.

The pressure liquid chamber 2 is connected to a common liquid chamber 9 via a fluid resistor 7 and a communicating unit 8. The common liquid chamber 9 is also connected to an unshown ink tank. The actuator 5 is deformed based on the voltage applied by an unshown driving circuit, and the vibration board 3 is deformed based on the deformation of the actuator 5 so as to increase or decrease the capacity of the pressure liquid chamber 2. Increasing the capacity of the pressure liquid chamber 2 results in a decrease in internal pressure of the pressure liquid chamber 2, thereby supplying ink to the pressure liquid chamber 2 from the common liquid chamber 9 via the communicating unit 8 and the fluid resistor 7. In contrast, decreasing the capacity of the pressure liquid chamber 2 by driving the actuator 5 results in an increase in the internal pressure of the pressurized chamber 2, thereby discharging the ink from the nozzle 1. The discharged ink forms scattered liquid droplets (i.e., ink droplets), and the scattered liquid droplets are adhered to an unshown recording medium (e.g., paper), thereby forming an image on the recording medium.

FIG. 2 is a cross sectional view of the liquid-droplet jet head 10 taken along the line A-A of FIG. 1. The actuator 5 includes driving actuators 5a arranged at positions to face the corresponding pressure liquid chambers 2, and supporting actuators 5b arranged at positions to face corresponding partitions 11 which partitions adjacently arranged pressure liquid chambers 2. The aforementioned structure of the liquid-droplet jet head 10 is hereinafter called a "bi-pitch structure". In the liquid-droplet jet head 10 having this bi-pitch structure, voltage is applied to the driving actuators 5*a* to deform the vibration board 3, whereas no voltage is applied to the supporting actuators 5*b*. The supporting actuators 5*b* are utilized for fixating the pressure liquid chambers 12 to the supporting substrate 4.

It is preferable that the nozzles 1 be arranged as densely as possible in the liquid-droplet jet head 10 so as to carry out processing with increased speed and provide higher quality of images. However, since the liquid droplet jet head 10 having the bi-pitch structure includes both the driving actuators 5*a* and the supporting actuators 5*b*, the number of the actuators 5 to be arranged is twice as many as the number of the nozzles 1 in total. Accordingly, it is generally difficult to manufacture such a liquid droplet jet head 10.

Then, it is suggested that the liquid droplet jet head 10 include the actuator 5 consisting only of the driving actuator 5*a* as shown in FIG. 3. Such a structure is hereinafter called a "normal-pitch structure". FIG. 3 is a view illustrating another example of the liquid-droplet jet head 10 according to the related art.

The liquid droplet jet head 10 having the normal-pitch structure only includes half the number of actuators 5 as compared to that of the liquid-droplet jet head 10 having the bi-pitch structure, and hence is suitable for manufacturing an increased number of nozzles.

However, since the liquid droplet jet head 10 having the normal-pitch structure includes no supporting actuators 5*b*, the pressure liquid chambers 12 are not sufficiently supported. Thus, the pressure liquid chambers 12 and nozzle plates 13 are pushed up by thrust force of the driving actuators 5*a*, thereby generating a crosstalk. The more the number of bits generated by driving the driving actuators 5*a* there is, the more thrust force may be generated by the driving actuators 5*a*, thereby increasing an adverse effect of the crosstalk on the characteristics of the jets. Thus, the characteristics of the jets vary with the increase or decrease in the number of bits generated by driving the actuators 5*a*.

In order to suppress such a crosstalk in the liquid droplet jet head 10 having the normal-pitch structure, Japanese Patent No. 3381678 and Japanese Patent No. 3248486 disclose technologies in which an inactive region of a piezoelectric element is polarized such that both ends of the inactive region are utilized as supporting pillars, thereby leaving the both ends of the inactive region electrically floating.

However, in the disclosed technologies of both Japanese Patent No. 3381678 and Japanese Patent No. 3248486, since the piezoelectric element needs to have a deep groove in order to form the supporting pillars, the supporting pillars may each have a shape with an extremely high aspect ratio. Accordingly, the supporting pillars of the piezoelectric element may develop fractures during the manufacturing process. Further, with such technologies, since some of the internal electrodes are cut off, arrangement of the electrodes in the inactive regions of the piezoelectric element may become complicated.

SUMMARY OF THE INVENTION

Accordingly, embodiments of the present invention may provide a novel and useful liquid-droplet jet head having plural nozzles discharging liquid droplets, liquid discharging apparatus having the liquid-droplet jet head, and image forming apparatus having the liquid discharging apparatus solving one or more of the problems discussed above. More specifically, the embodiments of the present invention attempt to provide the liquid-droplet jet head having the normal-pitch structure, a liquid discharging apparatus having the liquid-droplet jet head, and an image forming apparatus having the liquid discharging apparatus that can suppress crosstalk generation at low cost.

According to an embodiment of the invention, a liquid droplet jet head includes a pressure liquid chamber substrate including a plurality of nozzles discharging liquid droplets and a plurality of pressure liquid chambers communicated with the nozzles, a vibration board configured to partially form wall surfaces of the pressure liquid chambers, and a first pressure converter configured to vibrate the vibration board to change pressure in the pressure liquid chambers to discharge the liquid droplets from the nozzles, and including a piezoelectric element having an active region and a first inactive region and electrodes disposed to apply an electric force to the active region and not to apply an electric force to the first inactive region, and a groove separating the active region from the first inactive region formed not so deep as to reach one of the electrodes in a portion in the first inactive region facing the vibration board. In the liquid droplet jet head, the pressure liquid chamber substrate is supported by the first inactive region of the piezoelectric element.

According to an embodiment of the invention, a liquid droplet discharging apparatus includes the aforementioned liquid droplet jet head.

According to an embodiment of the invention, An image forming apparatus includes the aforementioned liquid droplet discharging apparatus configured to discharge liquid droplets to adhere the liquid droplets on a recording medium.

Additional objects and advantages of the embodiments will be set forth in part in the description which follows, and in part will be obvious from the description, or may be learned by practice of the invention. It is to be understood that both the foregoing general description and the following detailed description are exemplary and explanatory only and are not restrictive of the invention, as claimed.

DETAILED DESCRIPTION OF THE PREFERED EMBODIMENTS

A description is given below, with reference to the FIGS. 4 through 14 of embodiments of the present invention.

A liquid-droplet jet head according to the embodiments of the invention generally includes a pressure converter having a piezoelectric element, and electrodes disposed to form an active region in which an electric field is generated and applied to the piezoelectric element and inactive regions in which no electric field is applied to the piezoelectric element, with the piezoelectric element and the electrodes arranged in a layered manner. The pressure converter further includes a groove formed in one of the inactive regions of the piezoelectric element facing the vibration board such that the groove is not brought into contact with the electrodes so as to separate the active region from the inactive region.

First Embodiment

Figure 1:
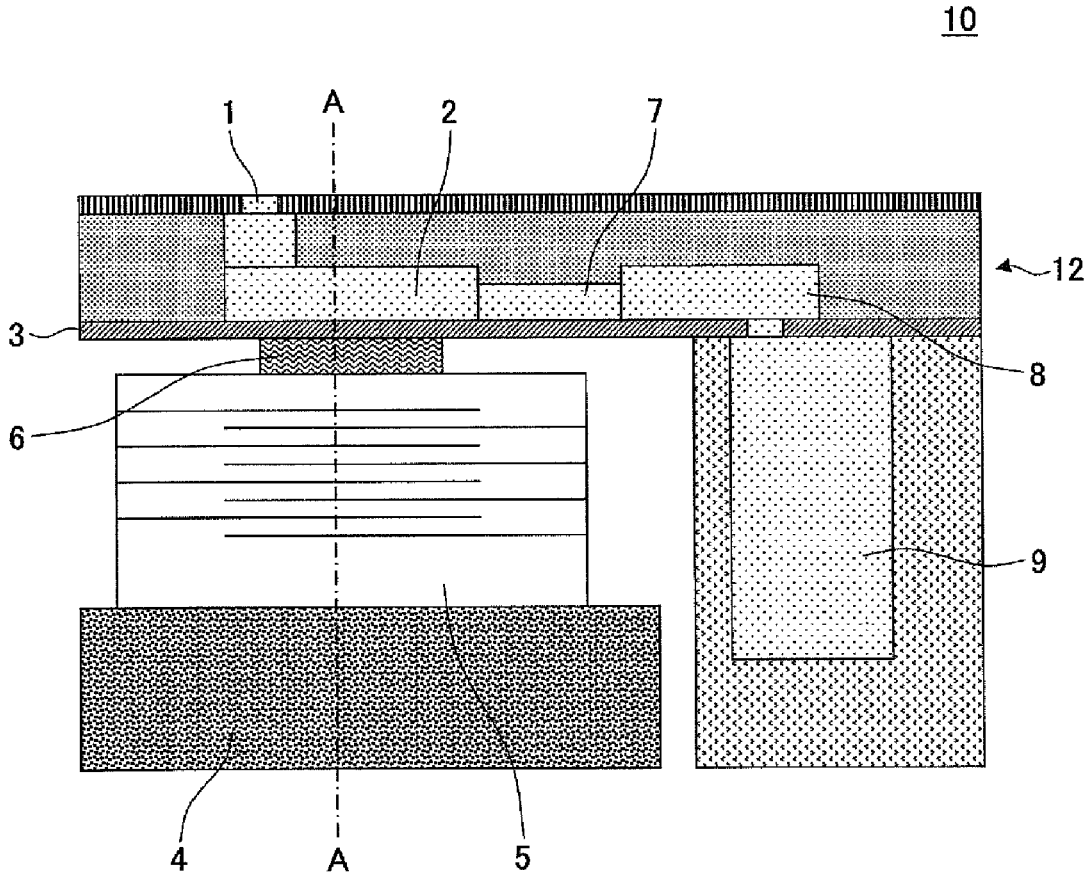
FIG. 1 is a view illustrating one example of a liquid-droplet jet head according to a related art.
Figure 2:
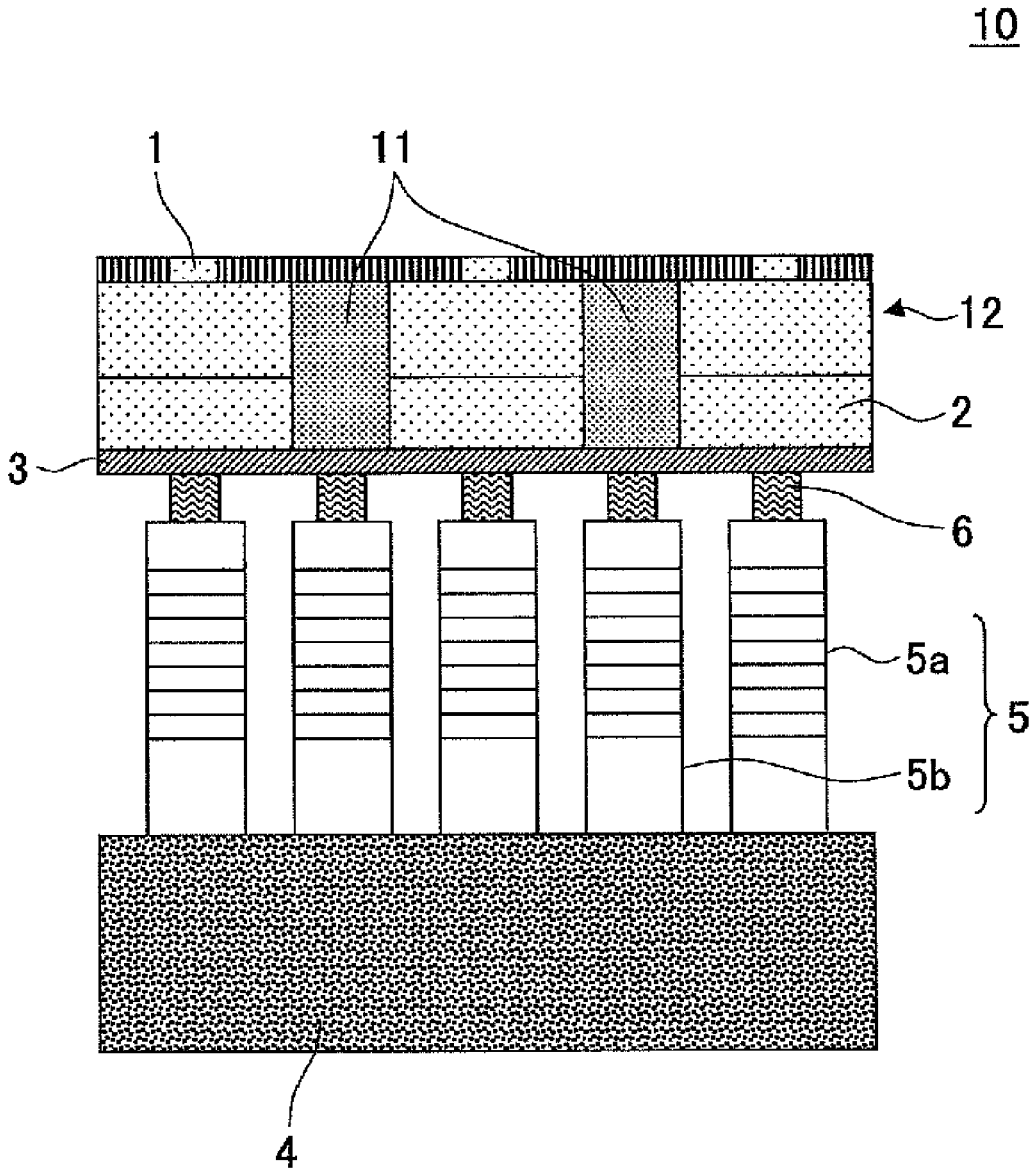
FIG. 2 is a cross sectional view of the liquid-droplet jet head according to the related art taken along the line A-A of FIG. 1.
Figure 3:
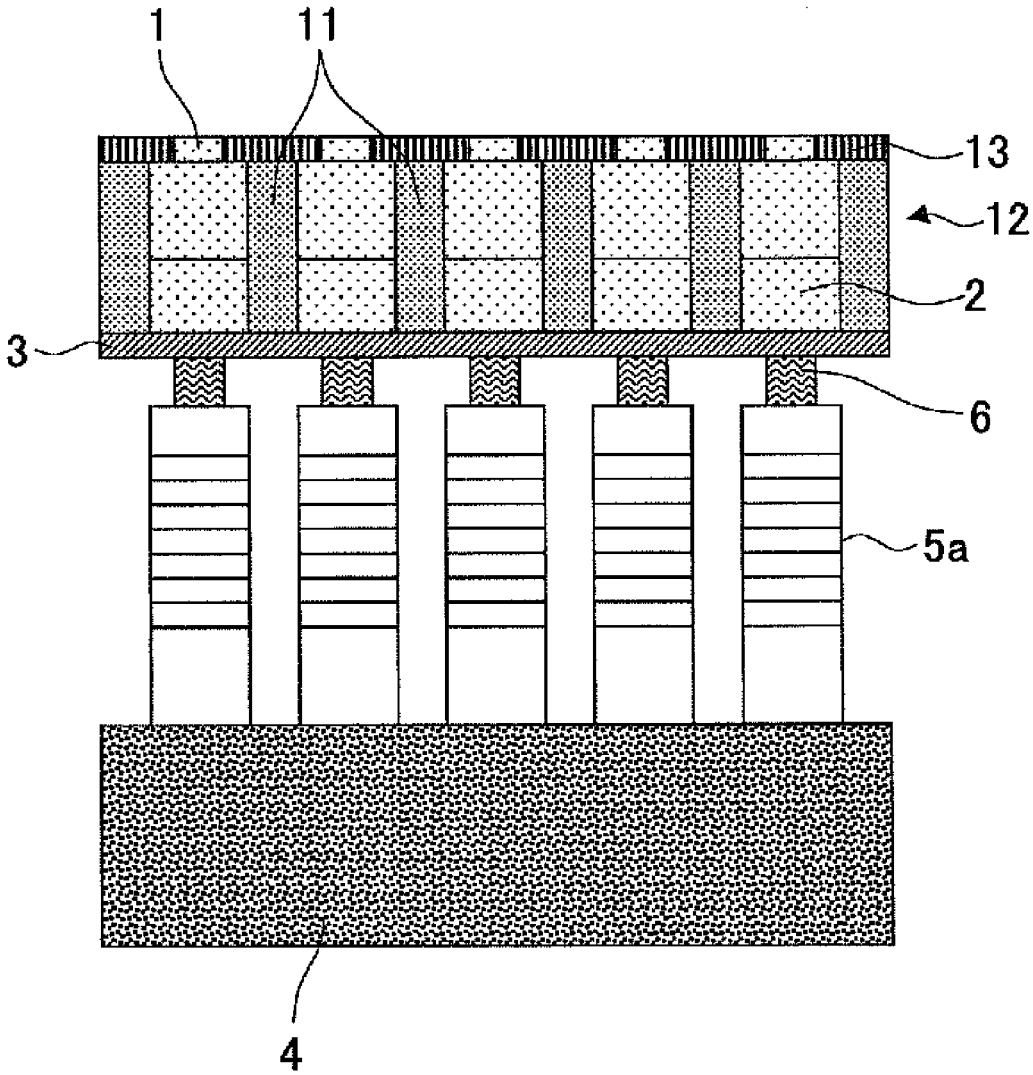
FIG. 3 is a view illustrating another example of the liquid-droplet jet head according to the related art.
Figure 4:
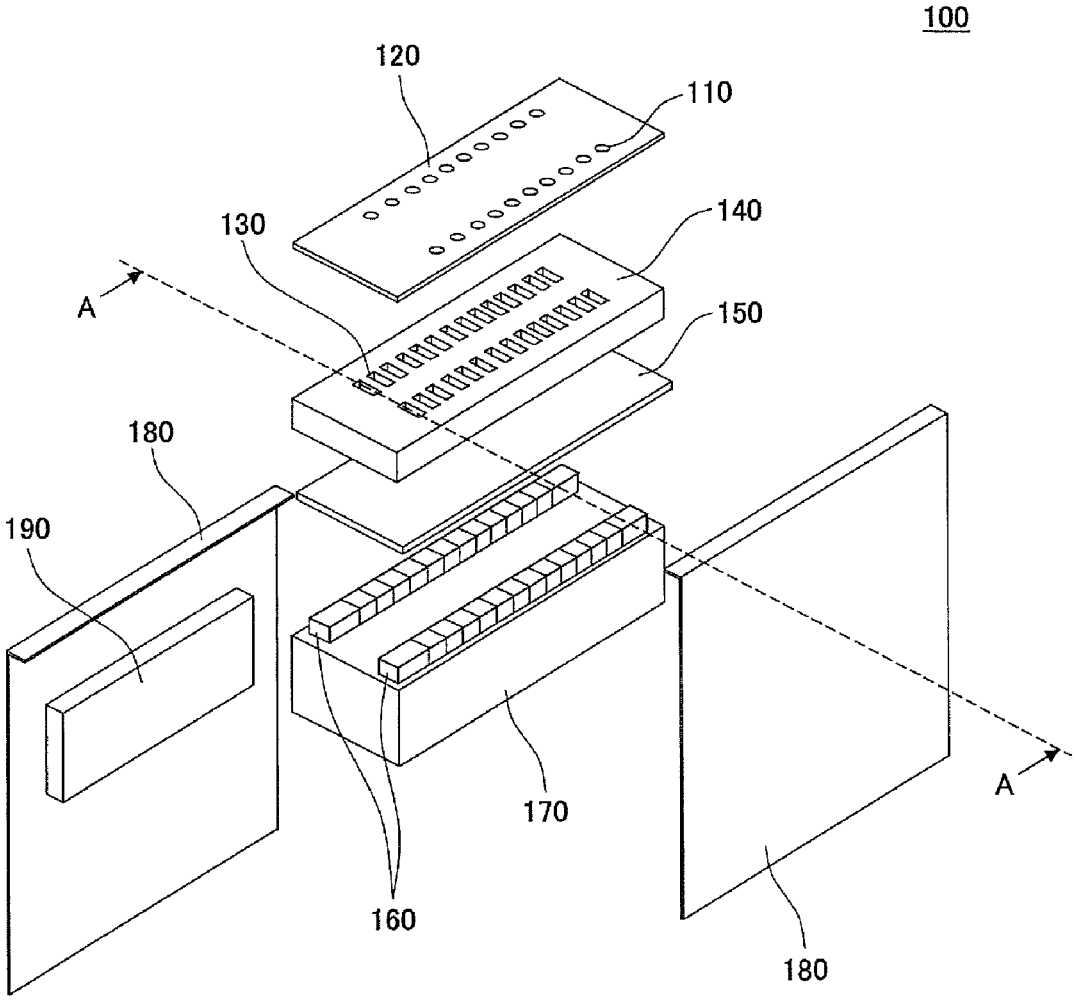
FIG. 4 is an exploded perspective view illustrating a liquid-droplet jet head according to a first embodiment.

A liquid-droplet jet head 100 according to a first embodiment of the invention is described with reference to accompanying drawings. FIG. 4 is an exploded perspective view illustrating the liquid-droplet jet head 100 according to a first embodiment.

The liquid-droplet jet head 100 includes a nozzle plate 120 having plural nozzles 110, a pressure liquid chamber substrate 140 having plural pressure liquid chambers 130, a vibration board 150, actuators 160, a supporting substrate 170, FPC cables 180, and driver ICs 190.

The plural nozzles 110 provided in the nozzle plate 120 are configured to communicate with the corresponding pressure liquid chambers 130. The pressure liquid chambers 130 are connected to common liquid chambers 230 (see FIG. 5) via fluid resistors 135 (see FIG. 6) and communicating units 220 (see FIGS. 5 and 6). The vibration board 150 is connected with the actuators 160 as pressure converters. The actuators 160 are electrically coupled with the FPC cables 180 connected to the driver ICs 190.

The driver ICs 190 generate a driving signal to drive the actuators 160 based on an image forming signal (not shown). The driving signal is supplied to the actuators 160 via the FPC cables 180. The actuators 160 expand and contract based on the supplied driving signal. The expansion or contraction of the actuators 160 is transmitted to the vibration board 150 as displacement. Internal pressure of the pressure liquid chambers 130 is controlled based on the displacement transmitted to the vibration board 150 so as to discharge ink-droplets (liquid droplets) from the nozzles 110. The actuators 160 are connected with the supporting substrate 170. The supporting substrate 170 is connected to frames 240 (see FIGS. 5 and 6).

The liquid-droplet jet head 100 is attached to a main body of an image forming apparatus such that the frames 240 (see FIG. 5) connected to the supporting substrate 170 are connected with an unshown carriage. The FPC cables 180 are connected with unshown electric circuits so as to supply ink from an unshown ink cartridge to the pressure liquid chambers 130. An example of the image forming apparatus having the liquid-droplet jet head 100 according to the first embodiment is described later.

Figure 5:
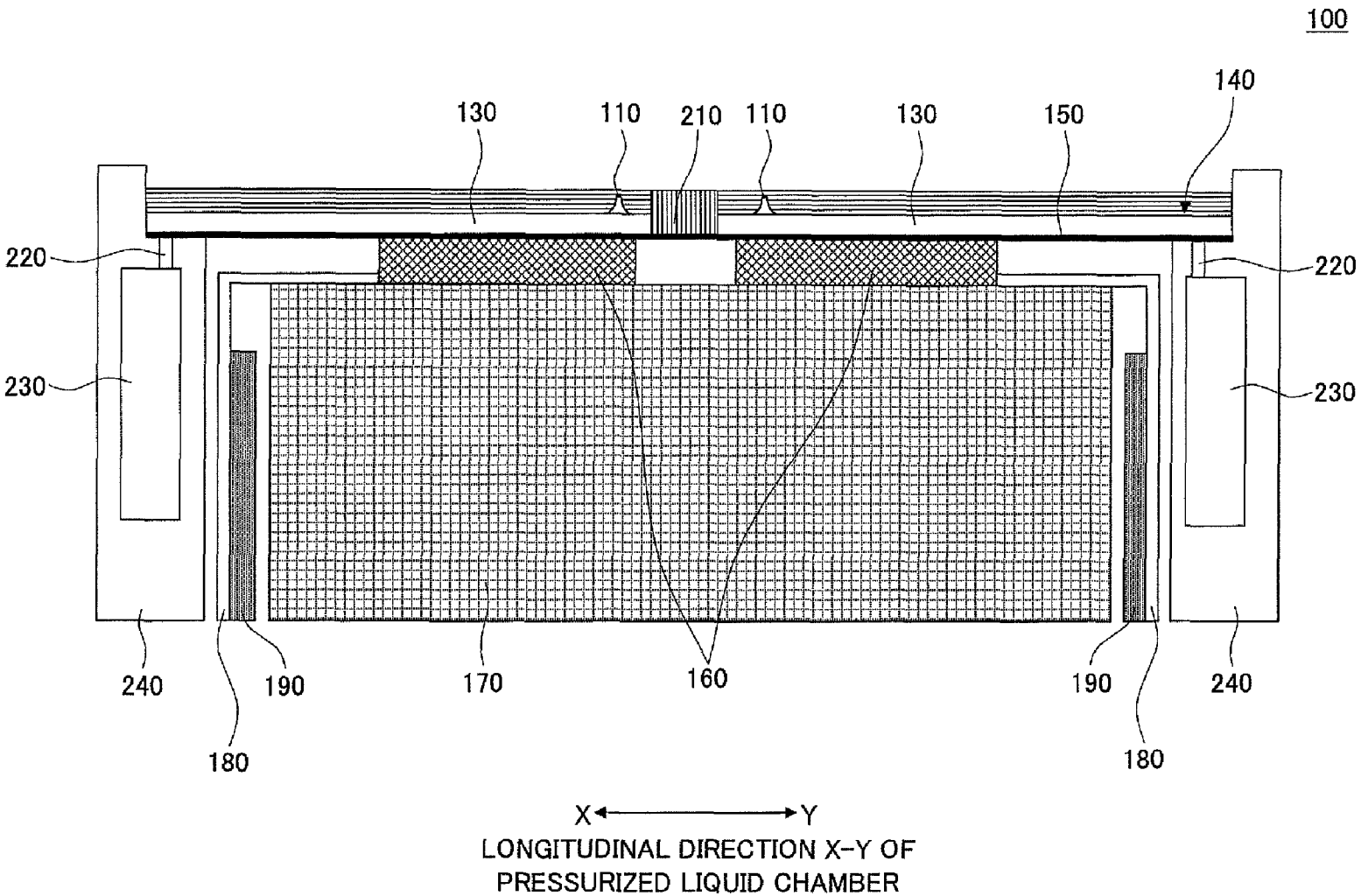
FIG. 5 is a cross sectional view of the liquid-droplet jet head according to the first embodiment taken along the line A-A.

FIG. 5 is a cross sectional view of the liquid-droplet jet head 100 according to the first embodiment taken along the line A-A.

In the liquid-droplet jet head 100 of the first embodiment, two pressure liquid chambers 130 are partitioned by a partition 210, so that the two pressure liquid chambers 130 are adjacently arranged to sandwich the partition 210. The pressure liquid chambers 130 communicates with the common liquid chambers 230 via the communicating units 220. The actuators 160 are electrically coupled with the FPC cables 180 connected to the driver ICs 190. The pressure liquid chamber substrate 140 and the supporting substrate 170 are connected with the frames 240.

In an example in FIG. 5, the frames 240 are formed of two separate components; however, the frames 240 may be formed of one component (i.e., one frame). Further, two actuators 160 are formed on one supporting substrate 170; however, the substrate 170 may be divided into two (i.e., two substrates). In the liquid-droplet jet head 100 of the first embodiment, the two pressure liquid chambers 130 are adjacently arranged in two rows in a longitudinal direction X-Y of the pressure liquid chamber, however, only one pressure liquid chamber 130 may be arranged in one row in the longitudinal direction X-Y of the pressure liquid chamber.

Figure 6:
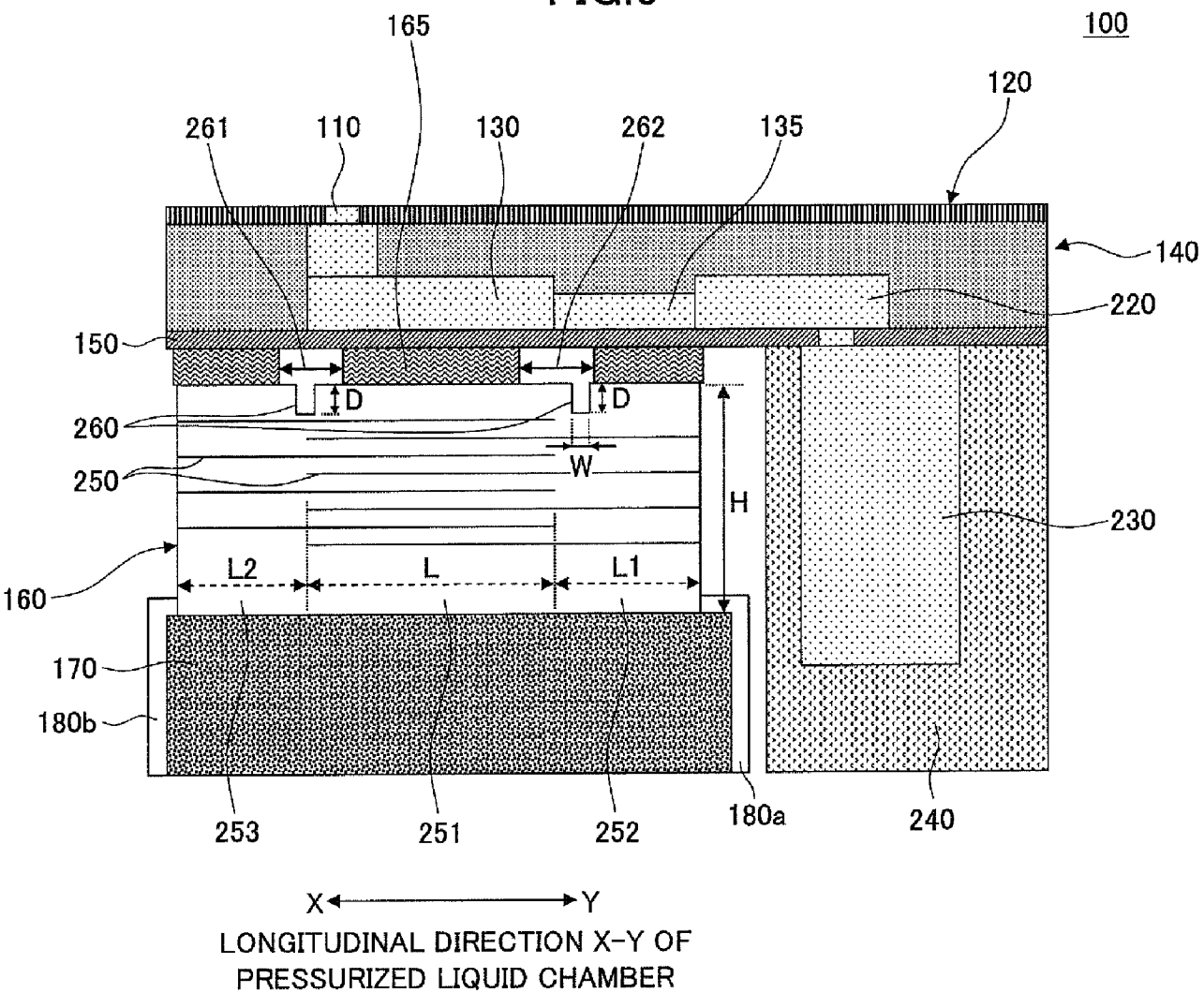
FIG. 6 is a detailed view of an actuator in the liquid-droplet jet head according to the first embodiment.

FIG. 6 is a detail view of an actuator 160 in the liquid-droplet jet head 100 according to the first embodiment.

In the liquid-droplet jet head 100 according to the first embodiment, the actuator 160 is connected to the vibration board 150 via the connecting unit 165, and includes a layered type piezoelectric element. The FPC cables 180 are individually connected to one side of the actuator 160 close to the common liquid chamber 230 and to the other side of the actuators 160. Hereinafter, the FPC cable 180 connected to the common liquid chamber 230 side of the actuator 160 is called an "external electrode 180*a*", and the FPC cable 180 connected to the other side of the actuator 160 is called an "external electrode 180*b*".

The actuator 160 is configured to include the piezoelectric element, and internal electrodes alternately connected to one of the external electrodes 180*a* and 180*b*, with the piezoelectric element and the internal electrodes arranged in a layered manner. The actuator 160 includes an active region 251 in which the internal electrodes 250 connected to the external electrode 180*a* are overlapped with the other internal electrodes 250 connected to the external electrode 180*b*, and inactive regions 252, 253 in which those connected to the external electrode 180*a* are not overlapped with those connected to the external electrode 180*b*.

In the actuator 160, when voltage is applied to the external electrodes 180*a*, 180*b*, the active region 251 is deformed due to the applied electric field. Since the inactive regions 252, 253 include the electrodes 250 connected to either one of the external electrode 180*a* and the external electrode 180*b*, no electric field is applied to the inactive regions 252, 253, thereby no deformation is caused in the inactive regions 252, 253. Accordingly, the inactive regions 252, 253 are utilized as supporting pillars for the pressure liquid chamber substrate 140.

In the actuator 160 of the first embodiment, it is preferable that a length L in the longitudinal direction X-Y of the pressure liquid chamber of the active region 251 be ranged from 1000 to 2000 μm, and lengths L1, 12 in the longitudinal direction X-Y of the pressure liquid chamber of the inactive regions 252, 253 be ranged from 400 to 800 μm. Note that lengths of either active or inactive regions are not limited to the aforementioned lengths. Further, the lengths L1, L2 in the longitudinal direction X-Y of the pressure liquid chamber of the inactive regions 252, 253 may either be the same or different.

The inactive regions 252, 253 individually include grooves 260. The groove 260 is provided so as to separate the inactive region 252 from the inactive region 253. According to the actuator 160 in the first embodiment, it is preferable that the width W of the groove 260 (see FIG. 6) be ranged from 20 to 50 μm in view of manufacturing process. Further, it is preferable that the grooves 260 be formed at positions closer to the active region 251 to increase the displacement of the active region 251. However, if the grooves 260 are formed too close to the active region 251, the grooves 260 may cut off some of the internal electrodes 250 in the active region 251. Thus, it is preferable that the grooves 260 each be formed at a position 50 to 100 μm distant from an end of the active region 251.

The grooves 260 are formed so as not to reach some of the internal electrodes 250 located closest to the vibration board 150, thereby preventing the grooves 260 from cutting off some of the internal electrodes 250. Thus, it is preferable that the depth D of each of the grooves 260 be ranged from 10 to 100 μm. If the depth D of the groove 260 exceeds 100 μm, it maybe difficult to process (form) the groove 260. Note that the width W, position, depth D of the groove 260 may not have to be within the aforementioned range.

According to the first embodiment, the connecting units 165 connecting the actuator 160 and vibration board 150 are not formed in regions 261, 262 in which the grooves 260 are formed. Accordingly, the actuator 160 in the first embodiment is connected with the vibration board 150 via the connecting units 165 intermittently formed in the active region 251, and the inactive regions 252, 253. As illustrated in FIG. 6, one of the connecting units 165 are formed in the active region 251 such that the connecting unit 165 does not interfere with the regions 261, 262. Further, other connecting units 165 are formed so as not to interfere with the regions 261, 262 in the inactive regions 252, 253.

According to the first embodiment, the actuator 160 is connected with the vibration board 150 via the connecting units 165. However, the actuator 160 may directly be connected to the vibration board 150 without connecting via the connecting units 165.

As described above, according to the first embodiment, the supporting pillars supporting the pressure liquid chamber substrate 140 may be formed without forming deep grooves 260 in the actuator 160. Further, since the grooves 260 are formed without cutting off any of the internal electrodes 250 in the actuator 160, the internal electrodes 250 in the inactive regions 252, 253 can be easily arranged. Thus, according to the first embodiment, the crosstalk generated in the liquid-droplet jet head 100 having the normal-pitch structure can be suppressed at low cost.

Figure 7:
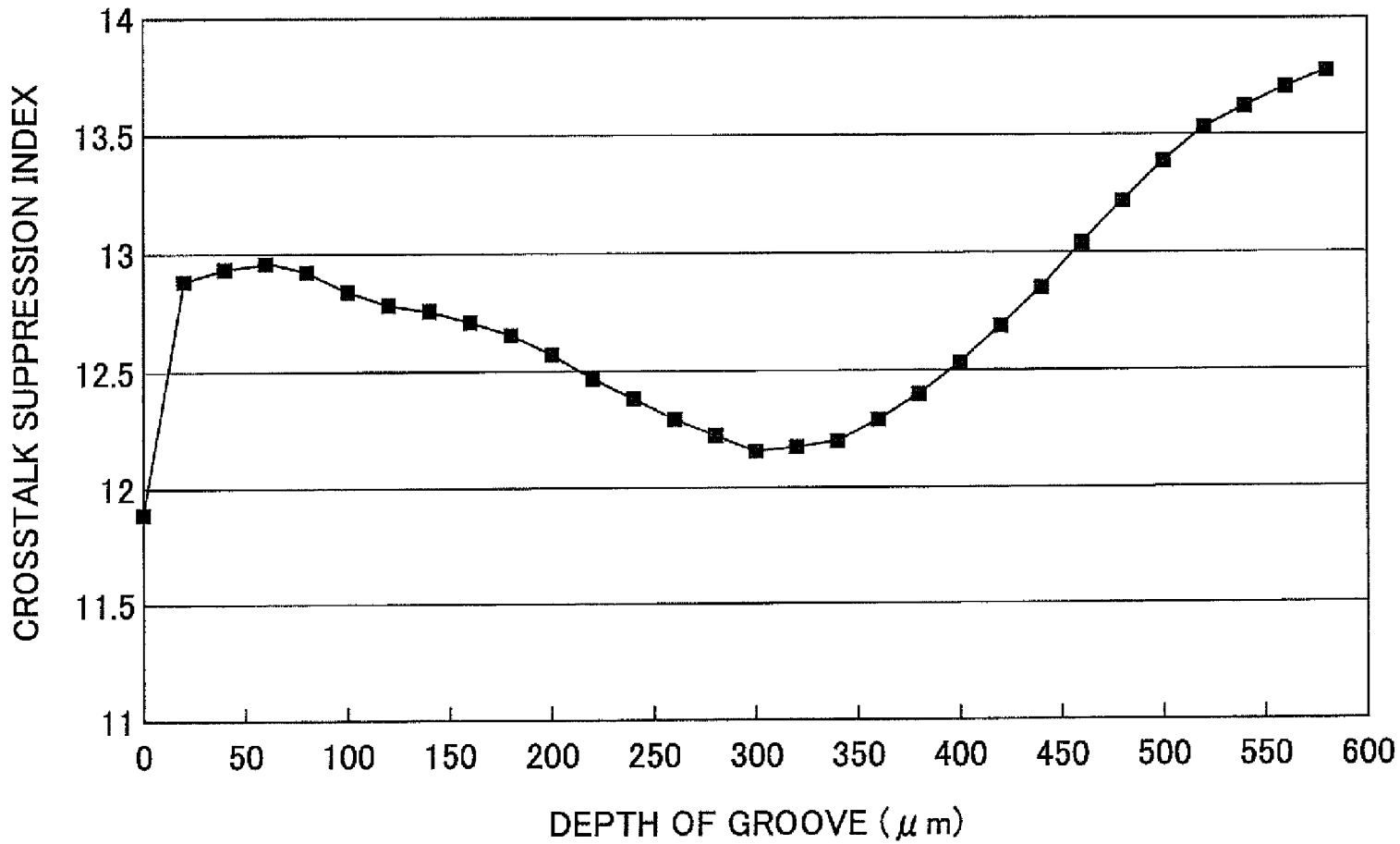
FIG. 7 is a graph illustrating an outcome of a numerical simulation analysis conducted on the liquid-droplet jet head according to the first embodiment.

FIG. 7 is a graph illustrating an outcome of a numerical simulation analysis conducted on the liquid-droplet jet head 100 according to the first embodiment. The numerical simulation analysis is a quantitative evaluation system in which the crosstalk suppression effects are quantitatively evaluated by varying the depth of the groove 260. In numerical simulation analysis, the length L of the active region is 1400 μm, the lengths L1, L2 of the inactive regions 252, 253 are each 500 μm, and the height H of the actuator 160 is 800 μm. In this analysis, the suppression of the crosstalk is evaluated using the following crosstalk suppression index.

Crosstalk suppression index=Generated pressure of the pressure liquid chamber 130/Displacement amount of the pressure liquid chamber substrate 140

When the pressure of the liquid chamber 130 rises, the pressure liquid chamber substrate 140 is pushed up, thereby increasing a displacement amount of the pressure liquid chamber substrate 140. This is a cause of the crosstalk. In order to suppress the crosstalk generation, it is preferable that the displacement amount of the pressure liquid chamber substrate 140 be kept as small as possible while maintaining discharge efficiency by a high pressure of the liquid chamber 130. Accordingly, the higher the value that the crosstalk suppression index is, the better the characteristics of the jets in the liquid-droplet jet head 100 may be.

As is clear from FIG. 7, in the liquid-droplet jet head 100 according to the first embodiment, even if a small depth of the groove 260 is formed in the actuator 160, the value of the crosstalk suppression index is increased, thereby exhibiting the effect of suppressing the crosstalk, in comparison to the related art liquid-droplet jet head where no groove is formed. In FIG. 7, the value of the crosstalk suppression index increases with an increase of the depth D of the groove 260 until the depth D of the groove 260 reaches approximately 100 μm. However, the value of the crosstalk suppression index decreases after the depth D of the groove 260 exceeds approximately 100 μm. Accordingly, it is preferable that the depth D of the groove 260 be approximately 100 μm or less. However, if the depth D of the groove 260 is continuously increased, the value of the crosstalk suppression index starts increasing again after the depth D of the groove 260 reaches approximately 350 μm. Then, when the depth D of the groove 260 reaches approximately 500 μm, the value of the crosstalk suppression index exceeds the value obtained when the groove 260 is formed only in a surface of the actuator 160. However, in such a case where the depth D of the groove 260 is approximately 500 μm, the groove 260 cuts off some of the internal electrodes 250, thereby making it complicated to arrange the internal electrodes. In order to avoid such complicated arrangement of the internal electrodes, it is preferable to form the groove 260 only in the surface of the actuator 160. As is clear from FIG. 7, crosstalk suppression effects may sufficiently be obtained by forming the groove 260 only in the surface of the actuator 160.

Second Embodiment

A liquid-droplet jet head 100A according to a second embodiment of the invention is described with reference to accompanying drawings. The liquid-droplet jet head 100A according to the second embodiment differs in the actuator 160 in which the groove is formed only in one inactive region in the liquid-droplet jet head according to the first embodiment. Accordingly, in the second embodiment, only the difference between the first and second embodiments is described. Identical components in the second embodiment that fulfill the same function as those of the first embodiment are denoted by the same reference numerals and are not described again.

Figure 8:
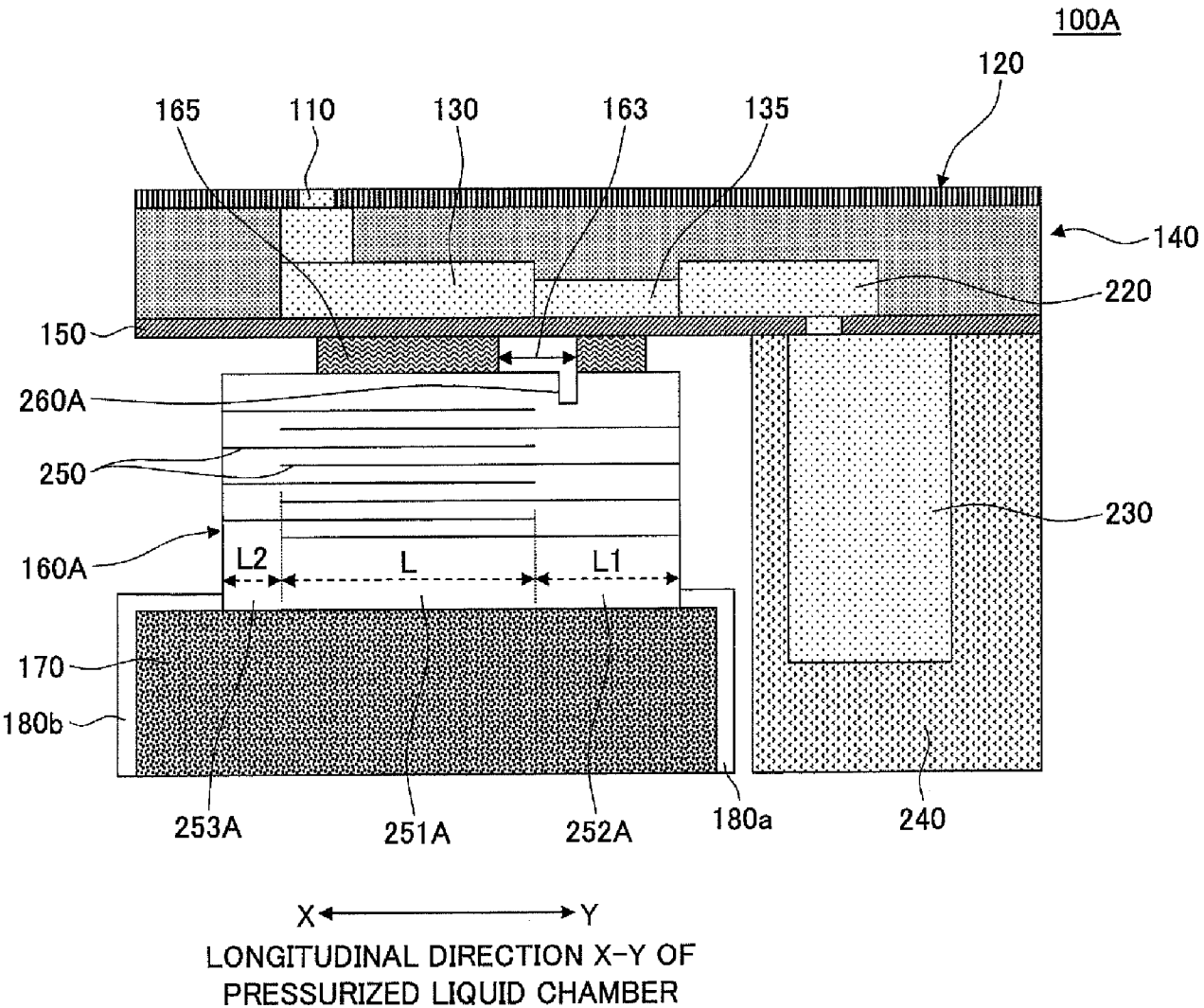
FIG. 8 is a detail view of an actuator in a liquid-droplet jet head according to a second embodiment.

FIG. 8 is a detailed view of an actuator 160A in the liquid-droplet jet head 100A according to the second embodiment.

The actuator 160A in the liquid-droplet jet head 100A according to the second embodiment includes inactive regions 252A, 253B adjacently formed at both sides of an active region 251A. The actuator 160A of the second embodiment is formed such that a length L1 of the inactive region 252A in the longitudinal direction X-Y of the pressure liquid chamber is longer than a length L2 of the inactive region 253A.

In the actuator 160A according to the second embodiment, a groove 260A is formed in the inactive region 252A alone. With this configuration, the length of the piezoelectric element in the longitudinal direction X-Y of the pressurized chamber may be decreased, thereby facilitating decreasing the size of the liquid-droplet jet head 100A.

Further, since the length L2 of the inactive region 253A is shorter than the length L1 of the inactive region 252A, a size of the active region 251A is less restricted by the inactive regions 252A, 253A in the actuator 160A of the second embodiment than that of the active region 251 restricted by the inactive regions 252, 253 in the actuator 160 of the first embodiment. As a result, a displacement amount of the piezoelectric element in the actuator 160A of the second embodiment is larger than that of the piezoelectric element in the actuator 160 of the first embodiment. Accordingly, efficiency of the jets in the liquid-droplet jet head 101A can be improved.

Note that in the second embodiment, the length L1 of the inactive region 252A is longer than the length L2 of the inactive region 253A. However, the relationship between the lengths L1 and L2 is not limited thereto. For example, the length L2 of the inactive region 253A may he longer than the length L1 of the inactive region 252A. In such a case, the groove 260A is formed in the inactive region 253A alone. That is, the groove 260A is formed in one of the inactive regions 252A and 253A that is longer in length than the other in the longitudinal direction X-Y of the pressure liquid chamber.

Figure 9:
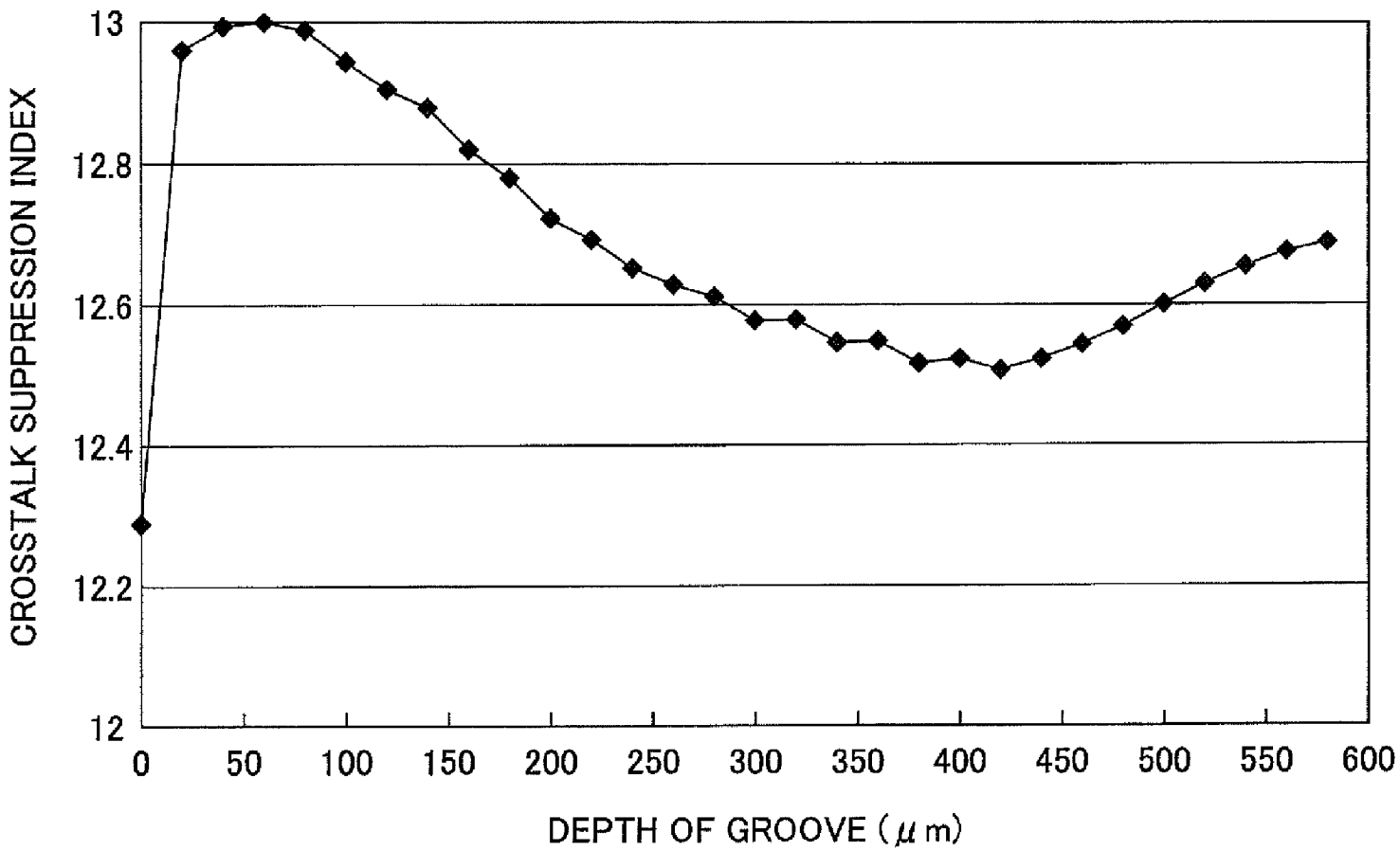
FIG. 9 is a graph illustrating an outcome of a numerical simulation analysis conducted on the liquid-droplet jet head according to the second embodiment.

FIG. 9 is a graph illustrating an outcome of a numerical simulation analysis conducted on the liquid-droplet jet head 100A according to the second embodiment. The details of the evaluation are the same as those in the first embodiment. In the numerical simulation analysis conducted on the liquid-droplet jet head 100A according to the second embodiment, the length L of the active region 251A is 1400 μm, the length L1 of the inactive region 252A is 500 μm, and the length L2 of the inactive region 253A is 150 μm.

As is clear from FIG. 9, the crosstalk can be suppressed best by forming the groove 260A having the depth D of 100 μm or less.

Third Embodiment

A liquid-droplet jet head 100B according to a third embodiment of the invention is described with reference to accompanying drawings. The liquid-droplet jet head 100B according to the third embodiment of the invention includes a combination of the actuators in the liquid-droplet jet head according to in the second embodiment. Accordingly, identical components in the third embodiment that fulfill the same function as those of the second embodiment are denoted by the same reference numerals and are not described again.

Figure 10:
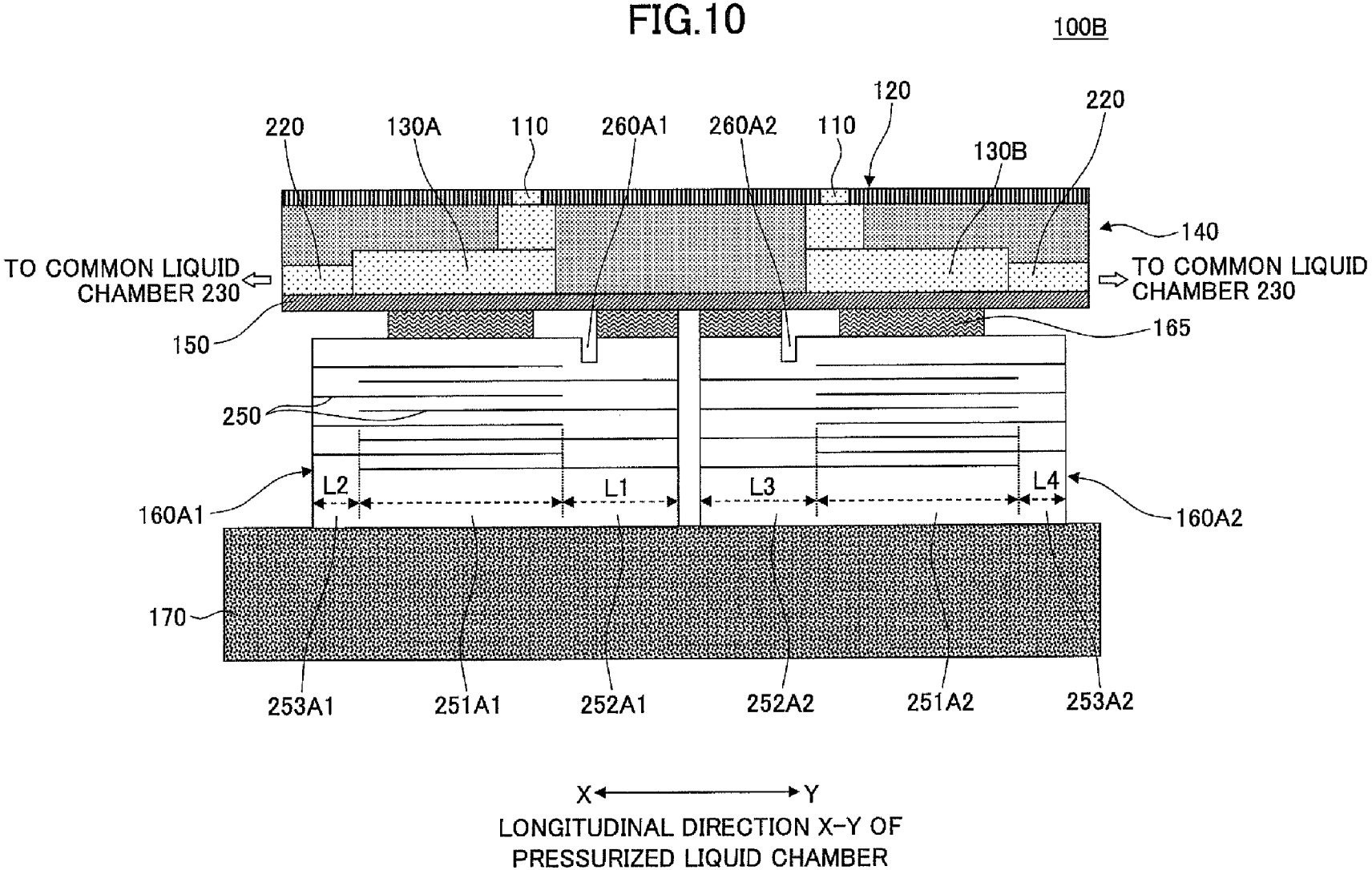
FIG. 10 is a view illustrating a liquid-droplet jet head according to a third embodiment.

FIG. 10 is a view illustrating the liquid-droplet jet head 100B according to the third embodiment.

The liquid-droplet jet head 100B according to the third embodiment of the invention includes nozzles 110 arranged in plural rows (e.g., two rows in FIG. 10) in the longitudinal direction X-Y of the pressure liquid chamber, and the pressure liquid chambers 130 communicated with the nozzles 110. In the liquid-droplet jet head 100B according to the third embodiment, actuators 160Al, 160A2 are formed corresponding to the adjacently arranged pressure liquid chambers 130, and grooves 260A1, 260A2 are respectively formed in inactive regions 252A1, 252A2 located at sides where the actuators 160A1 and 160A2 mutually face.

The liquid-droplet jet head 100B according to the third embodiment includes the actuator 160A1 that changes the internal pressure of the pressure liquid chamber 130A, and the actuator 160A2 that changes the internal pressure of the pressure liquid chamber 130B.

The actuator 160A1 according to the third embodiment includes the inactive regions 252A1, 253A1 adjacently formed at both sides of an active region 251A1. In the actuator 160A1 according to the third embodiment, a length L1 of the inactive region 252A1 in the longitudinal direction X-Y of the pressure liquid chamber is longer than a length L2 of the inactive region 253A1 in the longitudinal direction X-Y of the pressure liquid chamber. Accordingly, the groove 260A1 is formed in the inactive region 252A1.

The actuator 160A2 according to the third embodiment includes the inactive regions 252A2, 253A2 adjacently formed at both sides of an active region 251A2. In the actuator 160A2 according to the third embodiment, a length L3 of the inactive region 252A2 in the longitudinal direction X-Y of the pressure liquid chamber is longer than a length L4 of the inactive region 253A2 in the longitudinal direction X-Y of the pressure liquid chamber. Accordingly, the groove 260A2 is formed in the inactive region 252A2.

Accordingly, in the actuator 160A2 of the third embodiment, the grooves 260A1, 260A2 are formed in inactive regions 252A1, 252A2 located at the sides where the actuators 160A1 and 160A2 mutually face. The pressure liquid chamber substrate 140 located at the sides where the actuators 160A1 and 160A2 mutually face may be most susceptible to deformation.

As described above, in the liquid-droplet jet head according to the third embodiment of the invention, the crosstalk can be efficiently suppressed by providing the inactive regions 252A1, 253A2 at the sides where the actuators 160A1 and 160A2 mutually face.

Fourth Embodiment

A liquid-droplet jet head according to a fourth embodiment of the invention is described with reference to accompanying drawings. The liquid-droplet jet head 100C according to the fourth embodiment differs in the connecting unit that is formed in an entire region between the actuator 160 and the vibration board 150 from the liquid-droplet jet head 100 according to the first embodiment. Accordingly, in the fourth embodiment, only the difference between the first and fourth embodiments is described. Identical components in the fourth embodiment that fulfill the same function as those of the first embodiment are denoted by the same reference numerals and are not described again.

Figure 11:
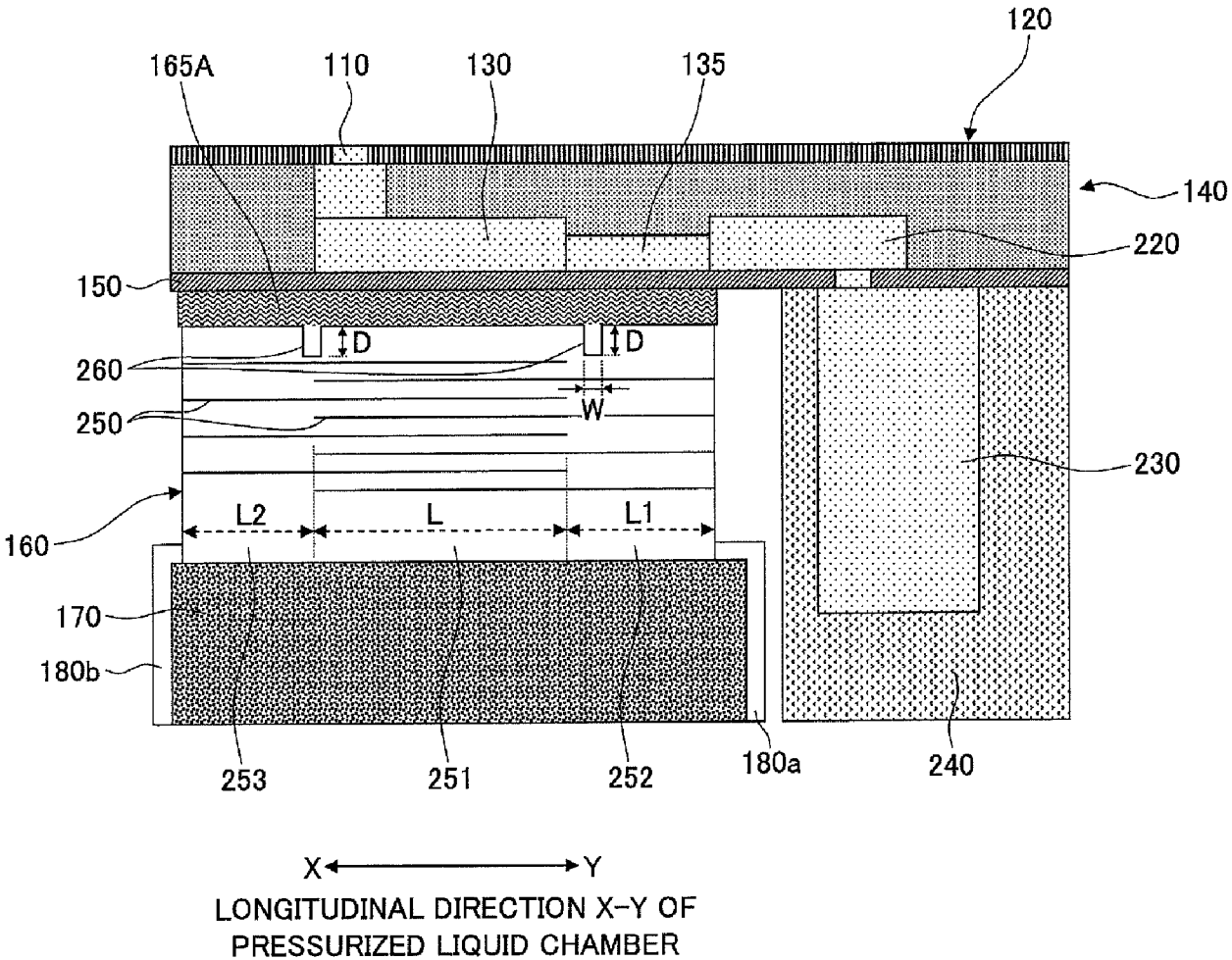
FIG. 11 is a view illustrating a liquid-droplet jet head according to a fourth embodiment.

FIG. 11 is a view illustrating the liquid-droplet jet head 100C according to the fourth embodiment.

The liquid-droplet jet head 100C according to the fourth embodiment includes a connecting unit 165A that is continuously formed in an entire region between the actuator 160 and the vibration board 150 in the longitudinal direction X-Y of the pressure liquid chamber. With this configuration, even if the positions of the grooves 260 are shifted in a horizontal direction, the characteristics of the jets may not vary to a large extent.

As shown in FIG. 6, the connecting units 165 are not provided above the grooves 260 in the liquid-droplet jet head 100 according to the first embodiment. If positions of the grooves 260 are shifted when attaching the actuator 160 to the liquid-droplet jet head 100, positions of the connecting units 165 and the grooves 260 may overlap. In the liquid-droplet jet head 100 according to the first embodiment, if the positions of the connecting units 165 and the grooves 260 overlap, a connected condition made by the connecting units 165 between the actuator 160 and the vibration board 150 changes. As a result, the jet characteristics of the liquid-droplet jet head 100 may vary.

Accordingly, in the liquid-droplet jet head 100C according to the fourth embodiment, the connecting unit 165A is continuously formed in the entire region between the actuator 160 and the vibration board 150.

With this configuration, even if the positions of the grooves 260 are shifted when attaching the actuator 160 to the liquid-droplet jet head 100C, the connected condition made by the connecting unit 165A between the actuator 160 and the vibration board 150 remains unchanged. As a result, fluctuation in the jet characteristics of the jets in the liquid-droplet jet head 100 may be reduced.

Note that in FIG. 11, a length of a layer of the vibration board 150 is longer than a length of the connecting unit 165A in the horizontal direction (i.e., longitudinal direction X-Y of the pressure liquid chamber). However, the actual vibration board 150 can be formed only under the pressure liquid chamber 130. Accordingly, the length of the actual vibration board 150 in the horizontal direction is longer than that of the connecting unit 165A in the horizontal direction.

Figure 12:
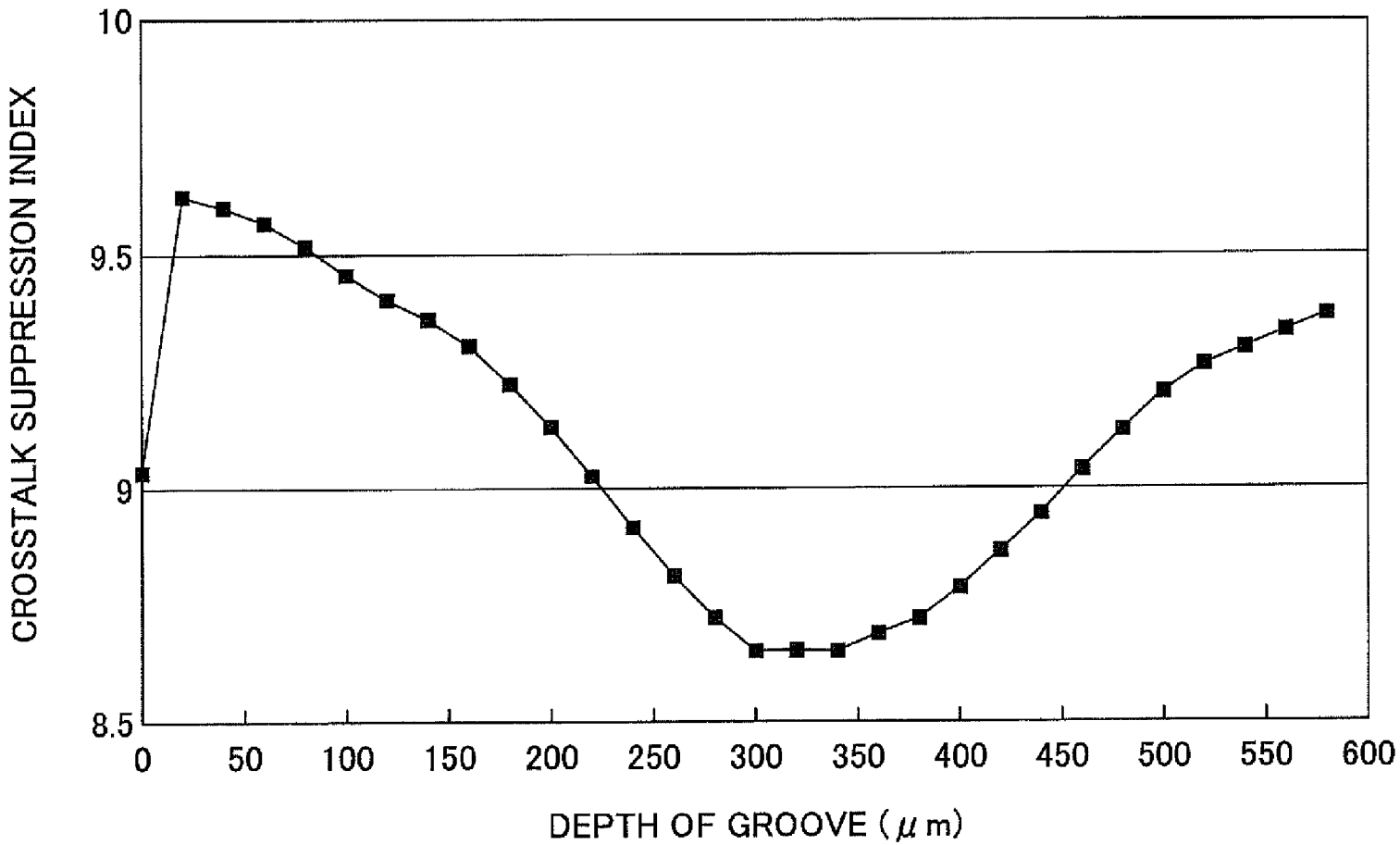
FIG. 12 is a graph illustrating an outcome of a numerical simulation analysis conducted on the liquid-droplet jet head according to the fourth embodiment.

FIG. 12 is a graph illustrating an outcome of a numerical simulation analysis conducted on the liquid-droplet jet head 100C according to the fourth embodiment. The details of the evaluation are the same as the first embodiment shown in FIG. 7. In the liquid-droplet jet head 100C according to the fourth embodiment, a length L of the active region 251 is 1400 μm, and lengths L1, L2 of the inactive regions 252, 253 are each 500 μm. As is clear from FIG. 12, the crosstalk suppression effects can be obtained with this configuration of the liquid-droplet jet head 100C according to the fourth embodiment.

Figure 13:
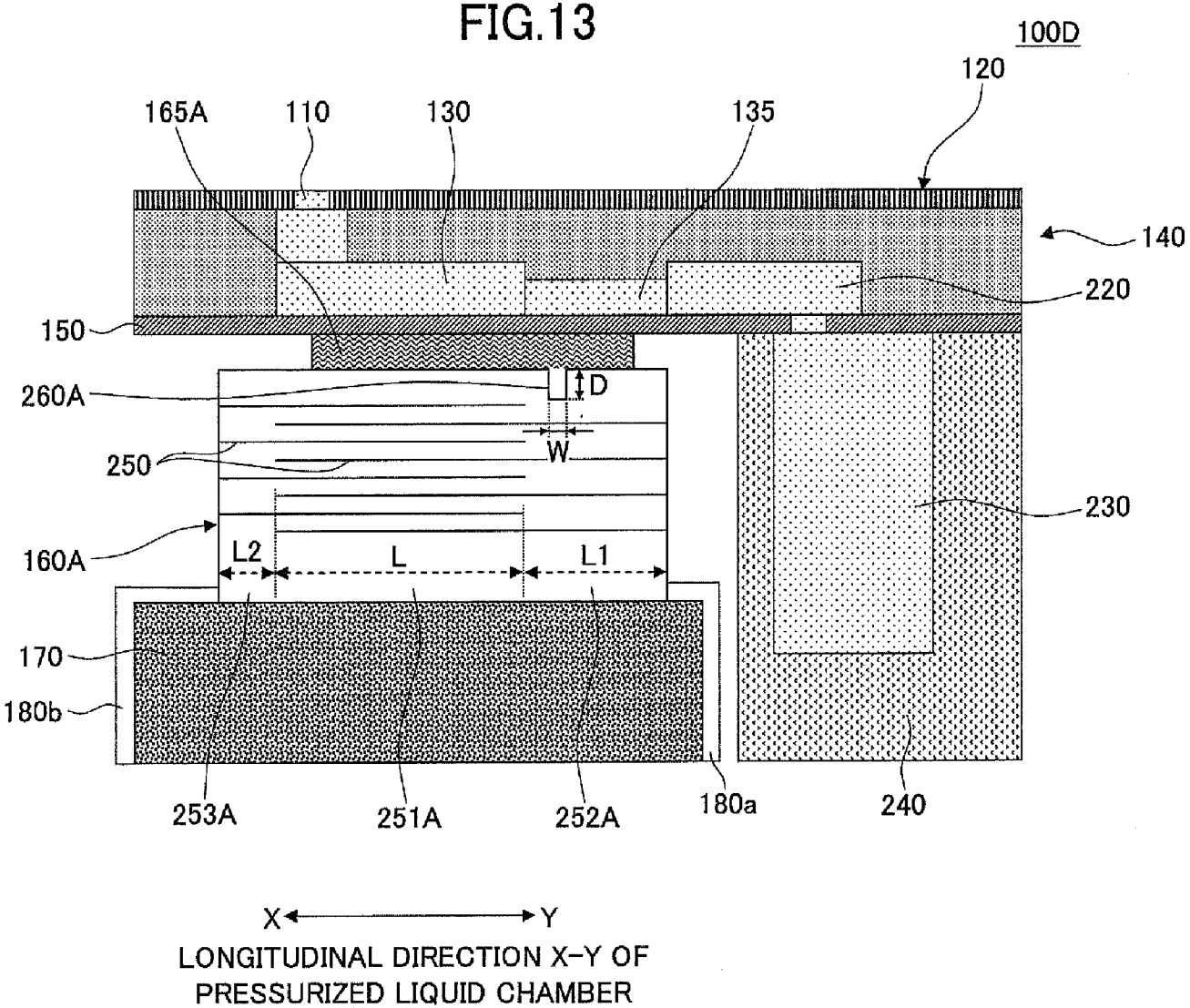
FIG. 13 is a view illustrating a modified liquid-droplet jet head obtained by applying the liquid-droplet jet head according to the fourth embodiment to the liquid-droplet jet head according to the second embodiment.

Note that the fourth embodiment may also be applied to the liquid-droplet jet head 101A according to the second embodiment. FIG. 13 is a view illustrating a liquid-droplet jet head 100D obtained by applying the liquid-droplet jet head 100C according to the fourth embodiment to the liquid-droplet jet head 101A according to the second embodiment (modification of the fourth embodiment). The liquid-droplet jet head 100D includes the connecting unit 165A continuously formed in an entire region between the actuator 160A and the vibration board 150.

Figure 14:
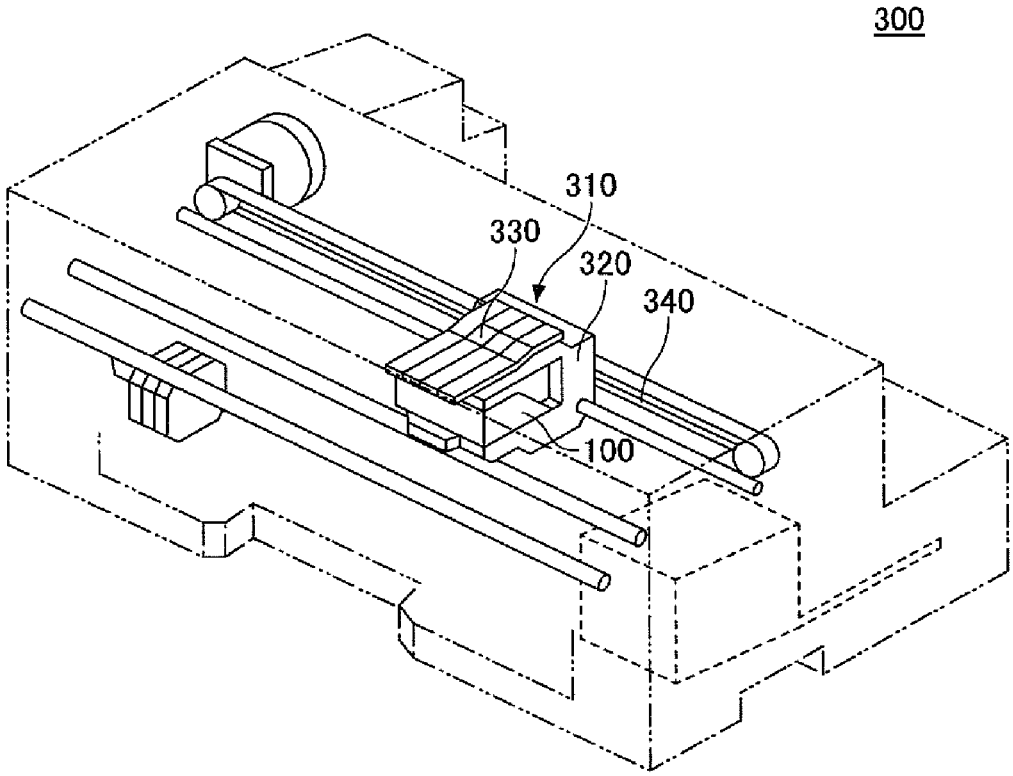
FIG. 14 is a view illustrating an image forming apparatus including a liquid discharging apparatus having one of the liquid-droplet jet heads according to the first to fourth embodiments.

An image forming apparatus including a liquid discharging apparatus having one of the aforementioned liquid-droplet jet heads 100, 100A, 100B, 100C, and 100D according to corresponding first to fourth embodiments may realize excellent characteristics of the jets and higher processing speeds of the jets. FIG. 14 is a view illustrating an image forming apparatus including a liquid discharging apparatus having one of the liquid-droplet jet heads according to the first to fourth embodiments.

An image forming apparatus 300 includes a liquid discharging apparatus 310 that is movable in a major scanning direction of the liquid discharging apparatus 310. The liquid discharging apparatus 310 includes a printing mechanical unit 340 including a carriage 320, the liquid-droplet jet head 100 attached to the carriage 320, and an ink cartridge 330 supplying ink to the liquid-droplet jet head 100. The image forming apparatus 300 obtains a sheet of paper from a paper-feeding cassette or a manual bypass tray, allows the printing mechanical unit 340 to print or record a desired image on the sheet, and discharges the sheet of paper on which the image is formed onto a discharging plate.

Note that the liquid-droplet jet head 100 according to the first embodiment is used as an example of the liquid-droplet jet head attached to the image forming apparatus 300 illustrated in FIG. 14; however, any one of the liquid-droplet jet heads 100A to 100D according to the corresponding first to fourth embodiments may be used.

With this configuration, the image forming apparatus 300 may realize less variability in printing characteristics and excellent image formation with high accuracy.

According to the liquid-droplet jet heads each having the normal-pitch structure according to the first to fourth embodiments, the crosstalk can be suppressed at low cost.

The liquid-droplet jet head, the liquid discharging apparatus and the image forming apparatus are described according to the first to fourth embodiments of the invention; however, the elements described in the embodiments are not limited thereto. Various changes and alterations may be made to those elements based on the applications of the embodiments without departing from the scope of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made hereto without departing from the spirit and scope of the invention.

This patent application is based on Japanese Priority Patent Application No. 2008-237128 filed on Sep. 16, 2008, the entire contents of which are hereby incorporated herein by reference.

What is claimed is:

1. A liquid droplet jet head comprising:

a pressure liquid chamber substrate including a plurality of nozzles discharging liquid droplets and a plurality of pressure liquid chambers communicated with the nozzles;

a vibration board configured to partially form wall surfaces of the pressure liquid chambers; and a first pressure converter configured to vibrate the vibration board to change pressure in the pressure liquid chambers to discharge the liquid droplets from the nozzles, and including a piezoelectric element having an active region and a first inactive region and electrodes disposed to apply an electric force to the active region and not to apply an electric force to the first inactive region, and a groove separating the active region from the first inactive region formed not so deep as to reach one of the electrodes in a portion in the first inactive region facing the vibration board, wherein the pressure liquid chamber substrate is supported by the first inactive region of the piezoelectric element.

2. The liquid droplet jet head as claimed in claim 1, wherein the piezoelectric element of the first pressure converter further includes a second inactive region, the first inactive region and the second inactive region are arranged respectively at a first side and a second side of the active region in a longitudinal direction of the pressure liquid chambers, one of the first and second inactive regions is longer in the longitudinal direction of the pressure liquid chambers than the other inactive region, and the groove is formed in the longer inactive region.

3. The liquid droplet jet head as claimed in claim 1, further comprising a second pressure converter that drives another plurality of nozzles in the pressure liquid chamber substrate and is adjacently arranged to the first pressure convereter, wherein the piezoelectric element of the first pressure converter further includes a second inactive region, and in the first pressure converter, the first inactive region and the second inactive region are arranged respectively at a first side and a second side of the active region in a longitudinal direction of the pressure liquid chambers, the groove is formed in one of the inactive regions that is formed at a second pressure converter side of the active region.

4. The liquid droplet jet head as claimed in claim 1, further comprising a connecting section formed between the first pressure converter and the vibration board to connect the first pressure converter and the vibration board, wherein the connection section is formed on a part of a surface of the first pressure converter at which no groove is formed.

5. The liquid droplet jet head as claimed in claim 1, further comprising a connecting section formed between the first pressure converter and the vibration board to connect the first pressure converter and the vibration board, wherein the connection section is continuously formed over an entire surface of the first pressure converter.

6. A liquid droplet discharging apparatus comprising the liquid droplet jet head as claimed in claim 1.

7. An image forming apparatus comprising the liquid droplet discharging apparatus as claimed in claim 6 configured to discharge liquid droplets to adhere the liquid droplets on a recording medium.

* * * * *